US008781349B2

(12) United States Patent
Hirata et al.

(10) Patent No.: US 8,781,349 B2
(45) Date of Patent: Jul. 15, 2014

(54) IMAGE FORMING APPARATUS PERFORMING IMAGE CONCENTRATION STABILIZATION CONTROL

(75) Inventors: Katsuyuki Hirata, Toyokawa (JP); Tomiko Imoto, Toyohashi (JP); Yoshinori Tsutsumi, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 414 days.

(21) Appl. No.: 13/050,029

(22) Filed: Mar. 17, 2011

(65) Prior Publication Data

US 2011/0229160 A1 Sep. 22, 2011

(30) Foreign Application Priority Data

Mar. 19, 2010 (JP) ..... 2010-064309

(51) Int. Cl.
*G03G 15/00* (2006.01)

(52) U.S. Cl.
USPC ..... 399/49

(58) Field of Classification Search
USPC ..... 399/30, 49, 60, 72, 301, 38; 347/116
See application file for complete search history.

(56) References Cited

U.S. PATENT DOCUMENTS

| | | | | |
|---|---|---|---|---|
| 6,035,152 | A * | 3/2000 | Craig et al. | 399/49 |
| 6,198,886 | B1 * | 3/2001 | Brewington | 399/49 |
| 6,483,996 | B2 * | 11/2002 | Phillips | 399/38 |
| 6,553,191 | B1 * | 4/2003 | Nakane | 399/38 |
| 6,999,708 | B2 | 2/2006 | Maeda | |
| 7,389,060 | B2 * | 6/2008 | Ishibashi | 399/30 |
| 7,432,494 | B2 | 10/2008 | Kanzaki | |
| 7,664,411 | B2 * | 2/2010 | Komiya | 399/38 |
| 8,036,552 | B2 | 10/2011 | Hashimoto | |
| 2008/0187337 | A1 * | 8/2008 | Kim et al. | 399/55 |

FOREIGN PATENT DOCUMENTS

| | | | |
|---|---|---|---|
| JP | 63-279275 | A | 11/1988 |
| JP | 08-251364 | A | 9/1996 |
| JP | 08334964 | A * | 12/1996 |
| JP | 09-172559 | A | 6/1997 |
| JP | 2000-206761 | A | 7/2000 |
| JP | 2003-035978 | A | 2/2003 |
| JP | 2003173052 | A * | 6/2003 |
| JP | 2003-316103 | A | 11/2003 |
| JP | 2004-287403 | A | 10/2004 |

(Continued)

OTHER PUBLICATIONS

Office Action (Notification of Reasons for Refusal) dated Aug. 21, 2012, issued in corresponding Japanese Patent Application No. 2010-064309, and an English Translation thereof. (7 pages).

(Continued)

*Primary Examiner* — Robert Beatty
(74) *Attorney, Agent, or Firm* — Buchanan Ingersoll & Rooney P.C.

(57) ABSTRACT

An image forming apparatus includes an image carrier that carries a toner image, an image forming device that forms the toner image on the image carrier, a sensing device that senses a toner concentration of the image carrier and a control device that makes the image forming device form a test toner image on the image carrier, and determines necessity to execute each adjustment operation for adjusting a plurality of kinds of driving conditions for the image forming device at the time of forming the toner images, based upon a toner concentration of the test toner image.

3 Claims, 15 Drawing Sheets

(56) References Cited

FOREIGN PATENT DOCUMENTS

| | | | | |
|---|---|---|---|---|
| JP | 2005-202110 | A | | 7/2005 |
| JP | 2005-266351 | A | | 9/2005 |
| JP | 2006-047941 | A | | 2/2006 |
| JP | 2006106222 | A | * | 4/2006 |
| JP | 2008-003396 | A | | 1/2008 |
| JP | 2008-225163 | A | | 9/2008 |
| JP | 2008225171 | A | * | 9/2008 |
| JP | 2009-093155 | A | | 4/2009 |
| JP | 2009-128715 | A | | 6/2009 |
| JP | 2009-139432 | A | | 6/2009 |

OTHER PUBLICATIONS

Office Action (Notification of Reasons for Refusal) dated Feb. 28, 2012, issued in the corresponding Japanese Patent Application No. 2010-064309, and an English Translation thereof. (5 pages).

* cited by examiner

IMAGE FORMING APPARATUS PERFORMING IMAGE CONCENTRATION STABILIZATION CONTROL

This application is based on Japanese Patent Application No. 2010-064309 filed on Mar. 19, 2010, the contents of which are incorporated herein by reference.

BACKGROUND OF THE INVENTION

1. Field of the Invention

The present invention relates to an image forming apparatus, and particularly relates to an image forming apparatus that forms a toner image.

2. Description of Related Art

As a conventional image forming apparatus, there is known, for example, a digital image forming apparatus described in Japanese Patent Application Laid-Open No. H08-251364. The digital image forming apparatus performs image concentration stabilizing control, which is described below. Specifically, a predetermined test toner image is formed on a photoreceptor by use of a developing unit. A toner adhering amount of the formed test toner image is detected by an AIDC sensor. A printer control section decides a grid potential of a charger and a development bias potential of each developing unit based upon the detected toner adhering amount, to form a predetermined image by use of the decided grid potential and development bias potential. Further, the printer control section changes an image forming condition for a next test toner image based upon the detected toner adhering amount such that the AIDC sensor can perform detection in an area with its detection sensitivity being high. It is thereby possible to accurately detect a toner adhering amount of the test toner image without being affected by characteristic fluctuations of the photoreceptor and a developer, so as to constantly form a favorable image by use of an optimal image forming parameter.

However, the digital image forming apparatus described in Japanese Patent Application Laid-Open No H08-251364 has a problem of a decreased print rate. More specifically, when the number of sheets of printed paper, operation time and the like satisfy certain conditions, the digital image forming apparatus executes the image concentration stabilizing control even without the need for changing the grid potential and the bias potential before or after the execution of the image concentration stabilizing control. Therefore, when certain conditions are satisfied during a printing operation, the digital image forming apparatus interrupts the printing operation and performs the image concentration stabilizing control even if there is no need for changing the grid potential and the bias potential. Such interruption of the printing operation causes a decrease in print rate in the digital image forming apparatus.

SUMMARY OF THE INVENTION

An image forming apparatus according to one aspect of the present invention includes: an image carrier that carries a toner image; an image forming device that forms the toner image on the image carrier; a sensing device that senses a toner concentration of the image carrier; and a control device that makes the image forming device form a test toner image on the image carrier, and determines necessity to execute each adjustment operation for adjusting a plurality of kinds of driving conditions for the image forming device at the time of forming the toner images, based upon a toner concentration of the test toner image.

BRIEF DESCRIPTION OF DRAWINGS

This and other objects and features of the present invention will be apparent from the following description with reference to the accompanying drawings, in which.

DETAILED DESCRIPTION OF PREFERRED EMBODIMENTS

Configuration of Image Forming Apparatus

Figure 1:
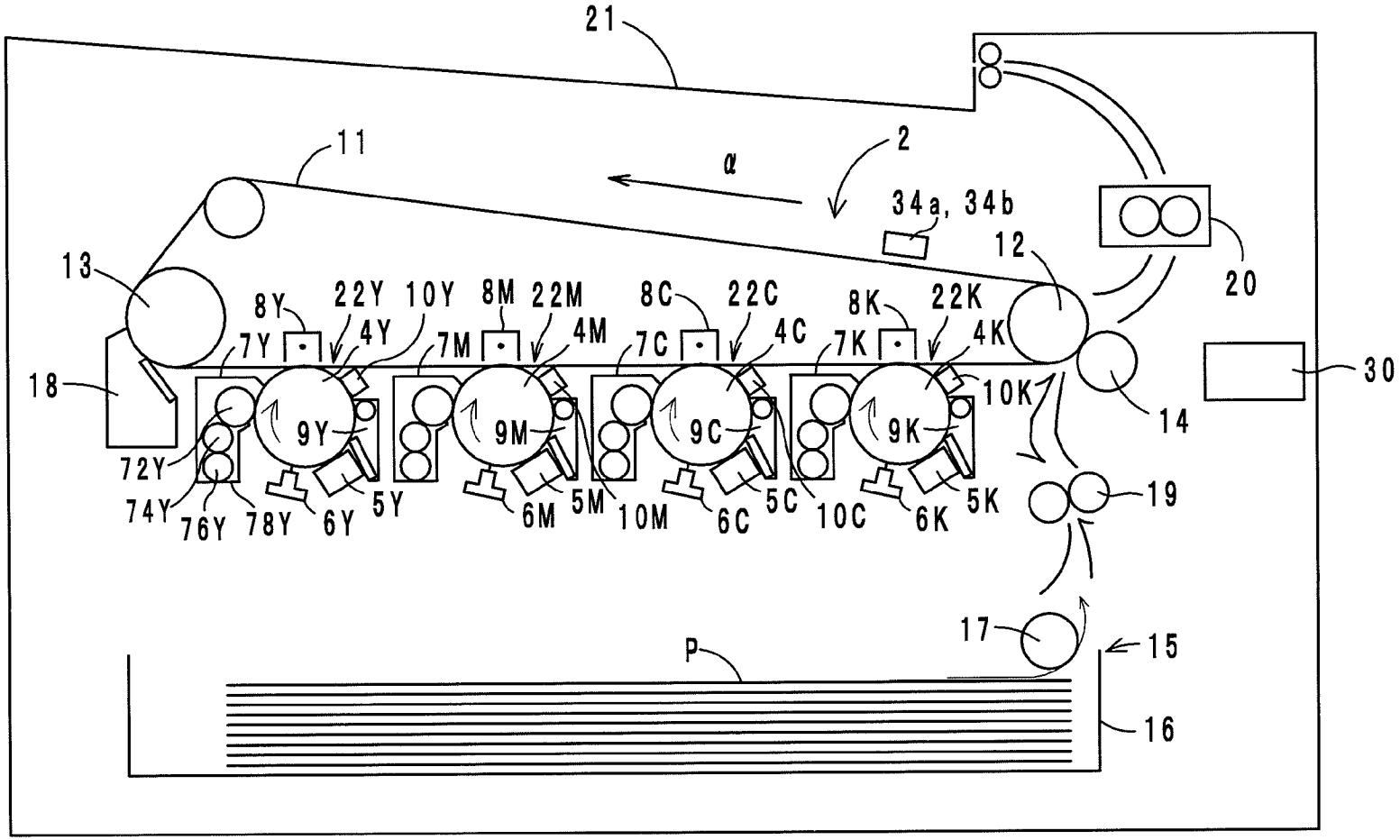
FIG. 1 is a view showing an overall configuration of an image forming apparatus according to an embodiment of the present invention.

Hereinafter, an image forming apparatus according to an embodiment of the present invention is described with reference to the drawings. FIG. 1 is a view showing an overall configuration of an image forming apparatus 1 according to the embodiment of the present invention.

An image forming apparatus 1 is an electrophotographic color printer of so-called tandem type, which is configured so as to synthesize an image of four colors [Y (yellow); M (magenta); C (cyan); K (black)]. The image forming apparatus 1 has a function of forming an image on paper (print medium) based upon image data inputted by reading by scanner or reception by a communication device, not shown, and the image forming apparatus 1 includes a printing section 2, a paper feeding section 15, a timing roller couple 19, a fixing unit 20, a paper discharge tray 21, a control section 30, and a sensors (sensing devices) 34*a*, 34*b*, as shown in FIG. 1.

The control section 30 controls an overall operation of the image forming apparatus 1 and is realized by a CPU, for example. The paper feeding section 15 serves to feed paper P one by one, and includes a paper tray 16 and a paper feeding roller 17. A plurality of pieces of paper P in a pre-printed state are stacked and placed in the paper tray 16. The paper feeding roller 17 takes out the paper P, placed in the paper tray 16, one by one. The timing roller couple 19 conveys the paper P, while adjusting the timing, so as to make a toner image secondarily transferred to the paper P in the printing section 2.

The printing section 2 forms a toner image on the paper P being fed from the paper feeding section 15, and includes: an image forming section 22 (22Y, 22M, 22C, 22K); a transfer section 8 (8Y, 8M, 8C, 8K); an intermediate transfer belt (image carrier) 11; a driving roller 12, a driven roller 13, a secondary transfer roller (opposed member, transfer member) 14, and a cleaning unit 18.

The image forming section 22 (22Y, 22M, 22C, 22K) includes: a photosensitive drum 4 (4Y, 4M, 4C, 4K), a charger 5 (5Y, 5M, 5C, 5K), an exposure unit 6 (6Y, 6M, 6C, 6K); a development unit 7 (7Y, 7M, 7C, 7K); a cleaner 9 (9Y, 9M, 9C, 9K), and an eraser 10 (10Y, 10M, 10C, 10K).

The charger 5 charges the peripheral surface of the photosensitive drum 4 to a negative potential. The exposure unit 6 applies a laser beam by control of the control section 30. A potential at a position irradiated with the laser beam is higher than a position not irradiated with the laser beam. Thereby, an electrostatic latent image is formed on the peripheral surface of the photosensitive drum 4.

As shown in FIG. 1, the development unit 7 (7Y, 7M, 7C, 7K) includes a development roller 72 (72Y, 72M, 72C, 72K), a feeding roller 74 (74Y, 74M, 74C, 74K), a stirring roller 76 (76Y, 76M, 76C, 76K), and a housing section 78 (78Y, 78M, 78C, 78K). In FIG. 1, for the sake of simplicity of the drawing, only the development roller 72Y, the feeding roller 74Y, the stirring roller 76Y, and the housing section 78Y of the development unit 7Y are provided with reference numerals.

The housing section 78 constitutes a body of the development unit 7, and houses toner, while storing the development roller 72, the feeding roller 74 and the stirring roller 76. The stirring roller 76 stirs the toner inside the housing section 78, to negatively charge the toner. The feeding roller 74 feeds the negatively charged toner to the development roller 72. The development roller 72 imparts the toner to the photosensitive drum 4. Specifically, a negative development bias voltage for forming a development field between the photosensitive drum 4 and the development roller 72 is applied to the development roller 72. Since the toner is negatively charged, the toner moves from the development roller 72 to the photosensitive drum 4 under the influence of the development field. Herein, a potential of a portion not irradiated with the laser beam on the peripheral surface of the photosensitive drum 4 is lower than a potential of the development roller 72. On the other hand, a portion irradiated with the laser beam on the peripheral surface of the photosensitive drum 4 is higher than the potential of the development roller 72. Therefore, the toner adheres to the portion irradiated with the laser beam on the peripheral surface of the photosensitive drum 4. A toner image based upon the electrostatic latent image is thereby developed on the photosensitive drum 4.

The intermediate transfer belt 11 is extended between the driving roller 12 and the driven roller 13. The driving roller 12 is rotated by an intermediate transfer belt driving section (not shown in FIG. 1), to thereby drive the intermediate transfer belt 11 in a direction of an arrow α (hereinafter referred to as conveyance direction α). The transfer section 8 is arranged so as to be opposed to the inner peripheral surface of the intermediate transfer belt 11, and serves to primarily transfer the toner image formed on the photosensitive drum 4 to the intermediate transfer belt 11 by being applied with a primary transfer voltage. At this time, each transfer section 8 performs primary transfer while adjusting timing, such that a toner image formed on each photosensitive drum 4 is superimposed to form a colored toner image on the intermediate transfer belt 11. As thus described, the transfer section 8 (8Y, 8M, 8C, 8K) and the image forming section 22 (22Y, 22M, 22C, 22K) function as an image forming device for forming a toner image on the intermediate transfer belt 11. The cleaner 9 serves to collect the toner remaining on the peripheral surface of the photosensitive drum 4 after the primary transfer. The eraser 10 discharges the peripheral surface of the photosensitive drum 4.

The driving roller 12 drives the intermediate transfer belt 11 in the conveyance direction α, whereby the intermediate transfer belt 11 conveys the toner image to the secondary transfer roller 14. Therefore, the intermediate transfer belt 11 functions as the image carrier to carry and convey the negatively charged toner image. The sensors 34*a*, 34*b* are provided so as to be opposed to the intermediate transfer belt 11, and sense a toner concentration of the intermediate transfer belt 11.

The secondary transfer roller 14 is opposed to the intermediate transfer belt 11, and forms a drum shape. The secondary transfer roller 14 is then applied with a transfer voltage held at a predetermined transfer potential so as to be held at a predetermined transfer potential. Thereby, the secondary transfer roller 14 secondarily transfers the toner image, being carried by the intermediate transfer belt 11, to the paper P passing between the intermediate transfer belt 11 and the secondary transfer roller 14. More specifically, the intermediate transfer belt 11 is in contact with the driving roller 12, and thereby held in a positive potential close to a ground potential. The transfer potential of the secondary transfer roller 14 is held so as to be higher than the potentials of the intermediate transfer belt 11 and the driving roller 12. Since the toner image is negatively charged, the toner image is transferred from the intermediate transfer belt 11 to the paper P through the electric field occurring between the driving roller 12 and the secondary transfer roller 14.

The cleaning unit 18 removes the toner remaining on the intermediate transfer belt 11 after secondary transfer of the toner image to the paper P.

The paper P with the toner image secondarily transferred thereto is delivered to the fixing unit 20. The fixing unit 20 performs heating treatment and pressure treatment on the paper, to thereby fix the toner image to the paper P. The printed paper P is placed in the paper discharge tray 21.

Incidentally, in the image forming apparatus 1, optimal driving conditions for the transfer section 8 and the image forming section 22 vary depending upon a temperature, humidity, the number of sheets of printed paper or a degree of deterioration in each section of the image forming apparatus 1. Therefore, in the image forming apparatus 1, maximum concentration control, γ-correction control and resist control, which are described below, are performed as necessary.

The maximum concentration control is an adjustment operation for adjusting driving conditions for the transfer section 8 and the image forming section 22 such that the highest toner concentration (hereinafter referred to as maximum concentration) that can be formed by the image forming section 22, namely a toner concentration of a solid image, becomes a toner concentration in an appropriate range. The driving condition in the maximum concentration control is a condition concerning adjustment of the maximum concentration, and examples thereof include setting for a bias voltage such as a development bias voltage and charging voltage, and setting for a maximum value of tone data.

The γ-correction control is an adjustment control for adjusting driving conditions for the transfer section 8 and the image forming section 22 such that a predetermined toner concentration (hereinafter referred to as half-tone concentration), which is lower than the maximum concentration, becomes a toner concentration in an appropriate range. The driving condition in the γ-correction control is a condition concerning adjustment of the half-tone concentration, and examples thereof include a tone correction table for use in conversion of inputted image data into data for forming a toner image.

The resist control is an adjustment control for adjusting driving conditions for the transfer section 8 and the image forming section 22 such that a plurality of toner images formed on the respective photosensitive drums 4 are superimposed as colored toner images in an accurate positional relation, on the intermediate transfer belt 11. The driving condition in the resist control is a condition concerning superimposition of colored toner images with four colors, and examples thereof include timing for writing video data in a main scanning direction, timing for writing video data in a sub-scanning direction, and setting for a video clock. It is to be noted that details of the driving conditions adjusted by the maximum concentration control, the γ-correction control and the resist control are the same as details of driving conditions generally adjusted in these operations, and descriptions thereof are thus not given.

The image forming apparatus 1 forms a test toner image on the intermediate transfer belt 11, and determines the necessity to execute the maximum concentration control, the γ-correction control and the resist control as described above based upon a toner concentration of the test toner image (hereinafter referred to as necessity determination operation). Hereinafter, the necessity determination operation is described in detail.

Figure 2:
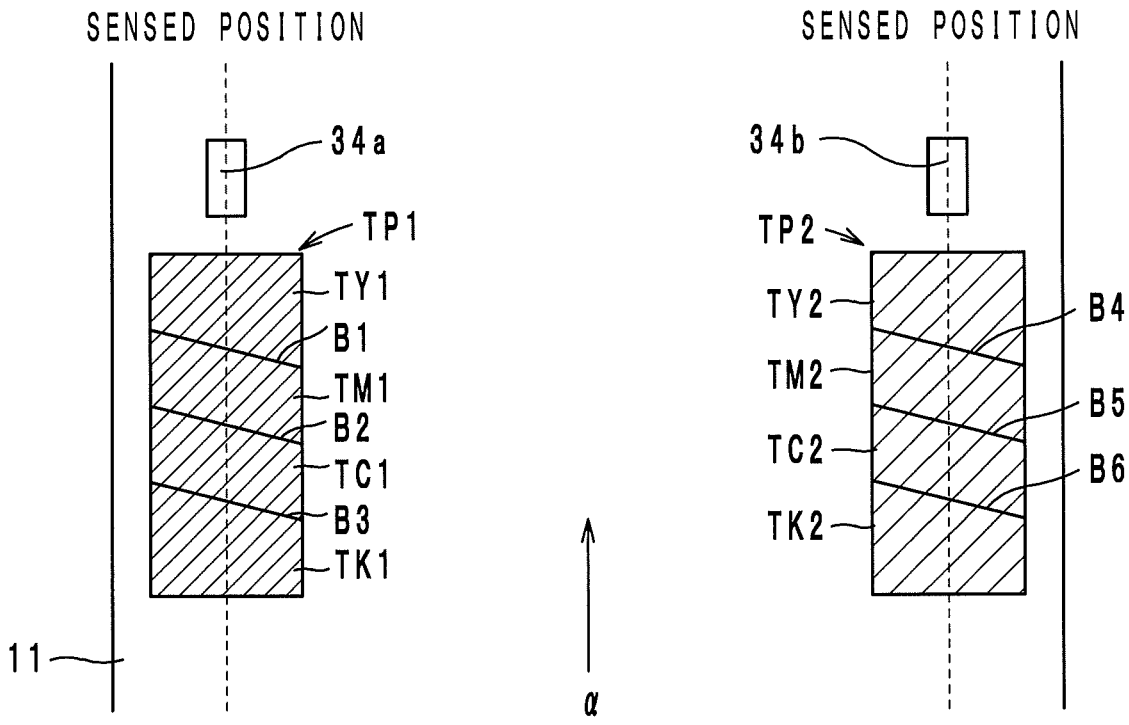
FIG. 2 is a view showing test toner images formed on an intermediate transfer belt.

First, a test toner image for use in the determination is described with reference to FIG. 2. FIG. 2 is a view showing test toner images TP1, TP2 formed on the intermediate transfer belt 11.

As shown in FIG. 2, the test toner image TP1 is a toner image formed in the vicinity of one side of the intermediate transfer belt 11, and having a maximum concentration. The test toner image TP1 is made up of toner images TY1, TM1, TC1, TK1 with a plurality of colors which align in the Conveyance direction α. Boundaries B1, B2, B3 of the toner images TY1, TM1, TC1, TK1 include portions not orthogonal to the conveyance direction α. In the present embodiment, the boundaries B1, B2, B3 are mutually in parallel, and form straight lines inclined with respect to the conveyance direction α. As shown in FIG. 2, the test toner image TP1 is conveyed by the intermediate transfer belt 11 in the conveyance direction α.

The sensor 34*a* is provided so as to be opposed to the vicinity of one side of the intermediate transfer belt 11, and senses a toner concentration of the test toner image TP1. As shown in FIG. 2, in the test toner image TP1, the sensor 34*a* senses a toner concentration at a middle point of a direction orthogonal to the conveyance direction α (represented as a sensed position in FIG. 2).

As shown in FIG. 2, the test toner image TP2 is a toner image formed in the vicinity of the other side of the intermediate transfer belt 11, and having a half-tone concentration. The test toner image TP2 is made up of toner images TY2, TM2, TC2, TK2 with a plurality of colors which align in the conveyance direction α. Boundaries B4, B5, B6 of the toner images TY2, TM2, TC2, TK2 include portions not orthogonal to the conveyance direction α. In the present embodiment, the boundaries B4, B5, B6 are mutually in parallel, and form straight lines inclined with respect to the conveyance direction α. As shown in FIG. 2, the test toner image TP2 is conveyed by the intermediate transfer belt 11 in the conveyance direction α.

The sensor 34*b* is provided so as to be opposed to the vicinity of the other side of the intermediate transfer belt 11, and senses a toner concentration of the test toner image TP2. As shown in FIG. 2, in the test toner image TP2, the sensor 34*b* senses a toner concentration at the middle point of the direction orthogonal to the conveyance direction α (represented as a sensed position in FIG. 2).

Figure 3:
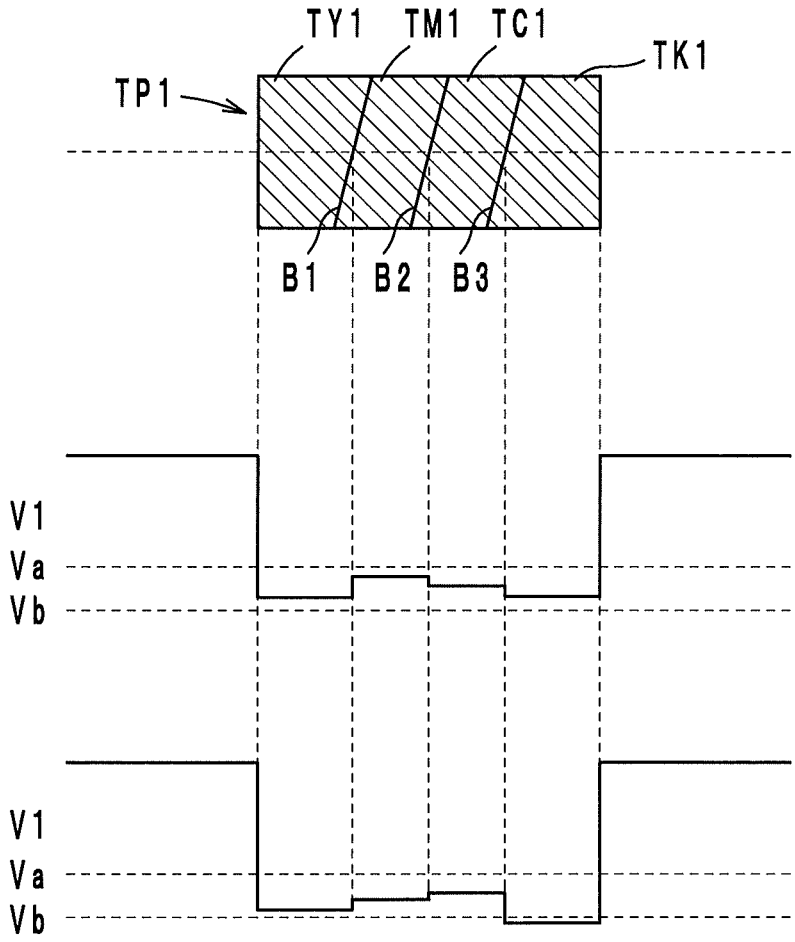
FIG. 3 is view showing a test toner image and an output signal of a sensor at the time of determining the necessity to execute maximum concentration control.

Next, determination of the necessity to execute the maximum concentration control is described with reference to the drawings. FIG. 3 is views showing the test toner image TP1 and an output signal V1 of the sensor 34*a* at the time of determining the necessity to execute the maximum concentration control. In FIG. 3, potentials Va, Vb respectively show an upper limit and a lower limit of a range in which the output signal V1 of the sensor 34*a* should stay when a toner image with the maximum concentration is sensed by the sensor 34*a*. It should be noted that voltages Va, Vb may be common values for each color, but may be set to different values according to sensitivity characteristics of the sensors 34*a*, 34*b*.

As shown in FIG. 3, when the output signal V1 of the sensor 34*a* stays between the voltage Va and the voltage Vb, the maximum concentration stays in the appropriate range, thus not requiring adjustment of the maximum concentration. Thereat, the control section 30 determines that execution of the maximum concentration control is not necessary.

On the other hand, as shown in FIG. 3, when the output signal V1 of the sensor 34*a* does not stay between the voltage Va and the voltage Vb, the maximum concentration does not stay in the appropriate range, thus requiring adjustment of the maximum concentration. Thereat, the control section 30 determines that execution of the maximum concentration control is necessary.

Figure 4:
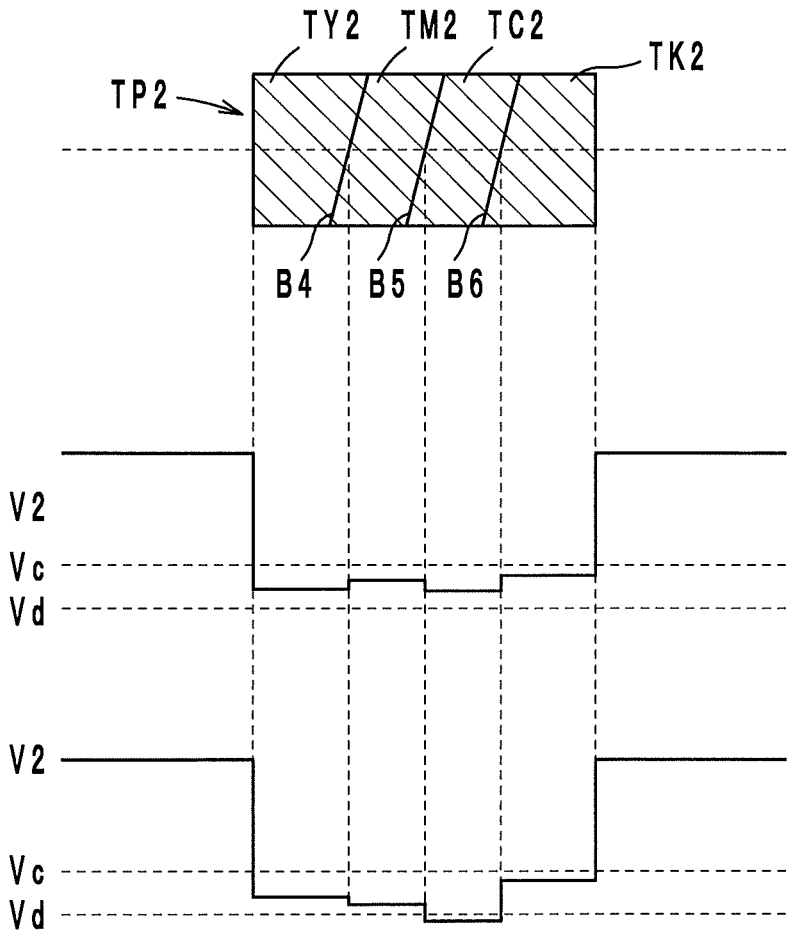
FIG. 4 is views showing a test toner image and an output signal of the sensor at the time of determining execution of γ-correction control.

Next, determination of the necessity to execute the γ-correction control is described with reference to the drawings. FIG. 4 is views showing the test toner image TP2 and an output signal V2 of the sensor 34*b* at the time of determining execution of the γ-correction control. In FIG. 4, potentials Vc, Vd respectively show an upper limit and a lower limit of a range in which the output signal V2 of the sensor 34*b* should stay when a toner image with the half-tone concentration is sensed by the sensor 34*b*. It should be noted that voltages Vc, Vd may be common values for each color, but may be set to different values according to the sensitivity characteristics of the sensors 34*a*, 34*b*.

As shown in FIG. 4, when the output signal V2 of the sensor 34*b* stays between the voltage Vc and the voltage Vd, the half-tone concentration stays in the appropriate range, thus not requiring adjustment of the half-tone concentration. Thereat, the control section 30 determines that execution of the γ-correction control is not necessary.

On the other hand, as shown in FIG. 4, when the output signal V2 of the sensor 34*b* does not stay between the voltage Vc and the voltage Vd, the half-tone concentration does not stay in the appropriate range, thus requiring adjustment of the half-tone concentration. Thereat, the control section 30 determines that execution of the maximum concentration control is necessary.

Figure 5A:
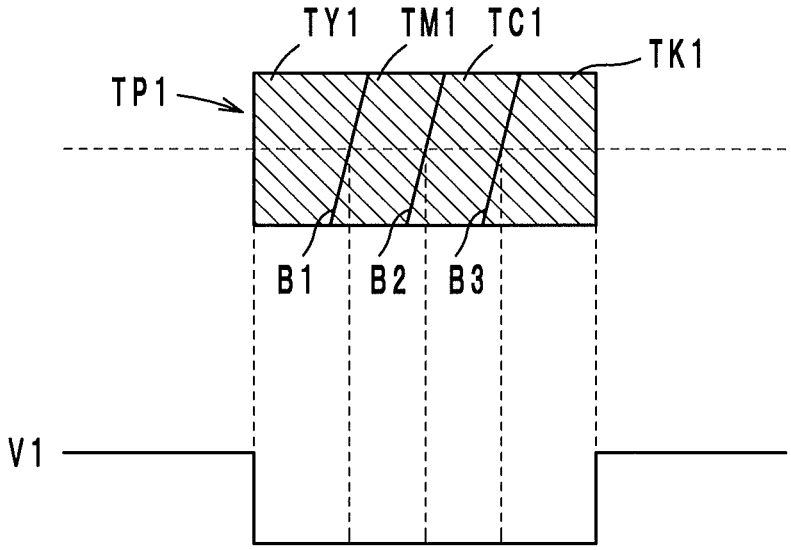
FIGS. 5A and 5B are views showing test toner images and output signals of the sensors at the time of determining the necessity to execute resist correction control.
Figure 5B:
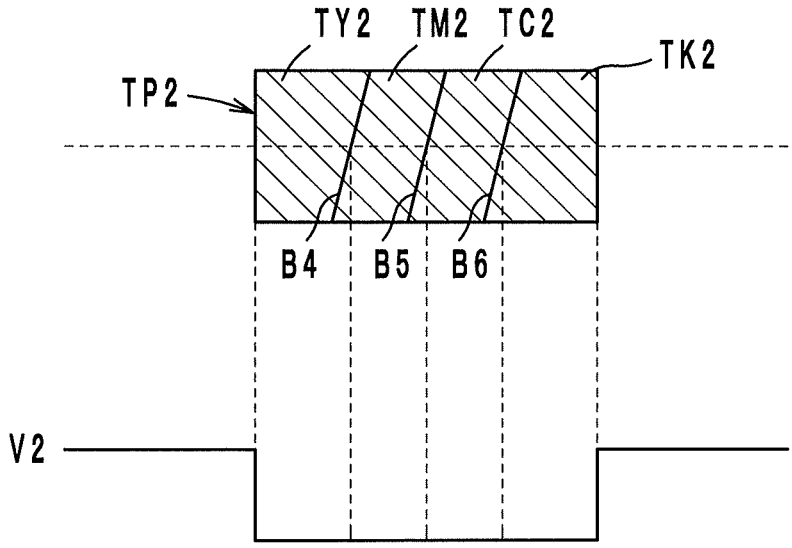
Figure 6A:
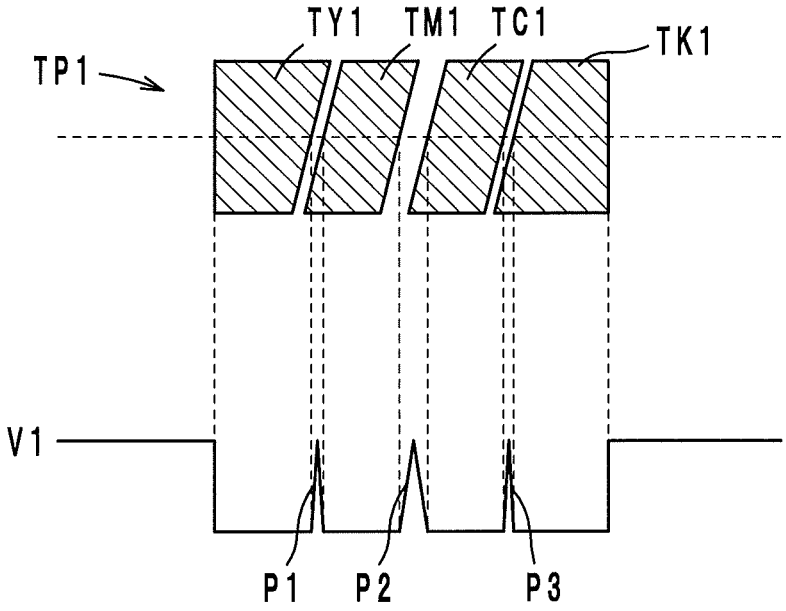
FIGS. 6A and 6B are views showing test toner images and output signals of the sensors at the time of determining the necessity to execute resist correction control.
Figure 6B:
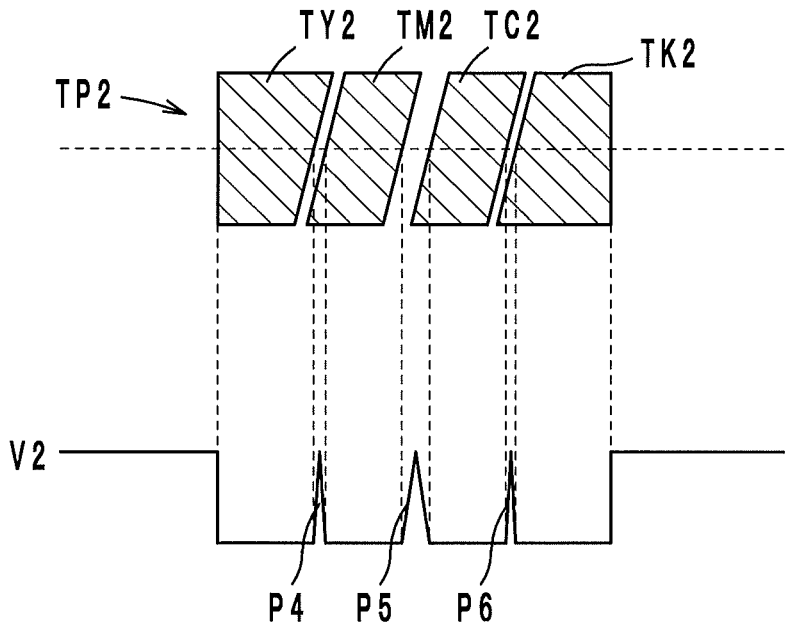
Figure 7A:
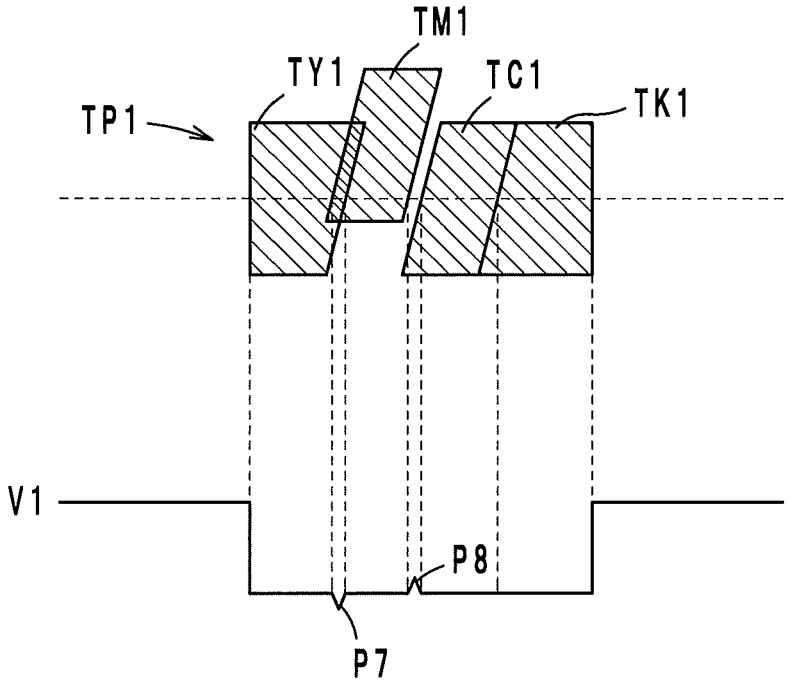
FIGS. 7A and 7B are views showing test toner images and output signals of the sensors at the time of determining the necessity to execute resist correction control.
Figure 7B:
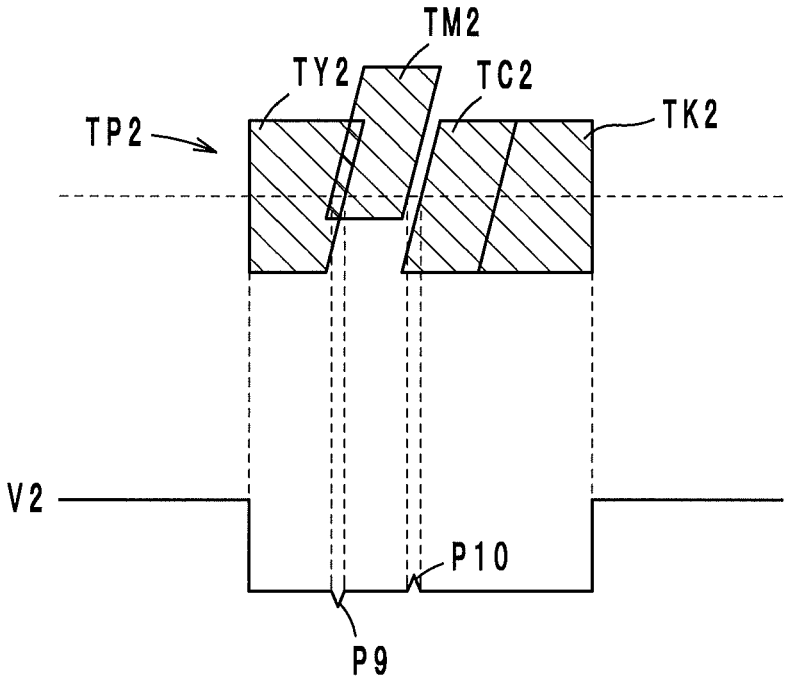
Figure 8A:
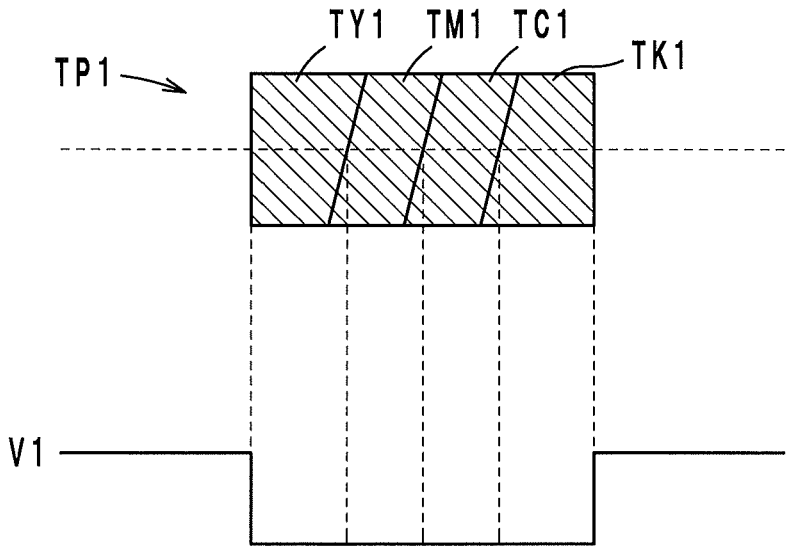
FIGS. 8A and 8B are views showing test toner images and output signals of the sensor at the time of determining the necessity to execute resist correction control.
Figure 8B:
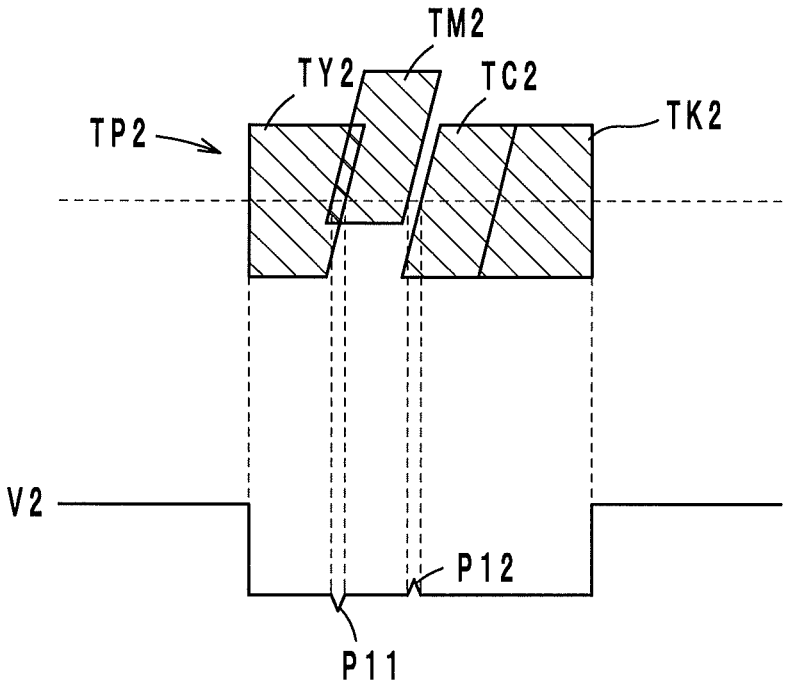

Next, determination of the necessity to execute the resist control is described with reference to the drawings. FIGS. 5A to 8B are views each showing the test toner images TP1, TP2 and the output signals V1, V2 of the sensors 34*a*, 34*b* at the time of determining the necessity to execute the resist correction control. In FIGS. 5A and 5B, print deviation has not occurred in the test toner images TP1, TP2. In FIGS. 6A and 6B, print deviation in the sub-scanning direction has occurred in the test toner images TP1, TP2. In FIGS. 7A and 7B, print deviation in the main scanning direction has occurred in the test toner images TP1, TP2. In FIGS. 8A and 8B, magnification deviation in the main scanning direction has occurred in the test toner images TP1, TP2. It is to be noted that the sub-scanning direction is a direction in parallel with the conveyance direction α, and the main scanning direction is a direction orthogonal to the sub-scanning direction (conveyance direction α) on the intermediate transfer belt 11. Further, the print deviation means that deviation has occurred in transferred positions of the toner images TY1, TM1, TC1, TK1, TY2, TM2, TC2, TK2, and the magnification deviation means that deviation has occurred in magnifications in the main scanning direction of the toner images TY1, TM1, TC1, TK1, TY2, TM2, TC2, TK2 due to thermal expansion of a scanning optical system, not shown.

When the print deviation and the magnification deviation have not occurred in the test toner images TP1, TP2 (see FIGS. 5A and 5B), the output signals V1, V2 are held in substantially constant potentials as shown in FIGS. 5A and 5B since the toner concentrations remain unchanged during a period of the sensors 34*a*, 34*b* sensing the test toner images TP1, TP2. In this case, the control section 30 determines that execution of the resist control is not necessary. It should be noted that, although the output signals V1, V2 slightly fluctuate in practice as shown in FIG. 3 and FIG. 4, such fluctuations are omitted in FIGS. 5A and 5B.

Upon occurrence of the print deviation in the sub-scanning direction in the test toner images TP1, TP2, gaps occur on boundaries among toner images TY1, TM1, TC1, TK1, TY2, TM2, TC2, TK2, as shown in FIGS. 6A and 6B. In this case, as shown in FIGS. 6A and 6B, the output signals V1, V2 are outputted with peaks P1 to P6 as increases in potential in detection of the gaps. Thereat, the control section 30 determines that execution of the resist control is necessary in the case of sensing the peaks P1 to P6.

When the print deviation in the main scanning direction occurs in the test toner images TP1, TP2, as shown in FIGS. 7A and 7B, the images with the same color (toner images TM1, TM2 in FIGS. 7A and 7B) are displaced in the same direction. The boundaries B1 to B6 of the toner images TY1, TM1, TC1, TK1, TY2, TM2, TC2, TK2 are inclined with respect to the conveyance direction α as shown in FIG. 2. Therefore, as shown in FIGS. 7A and 7B, a gap and an overlap occur on the boundaries among the toner images TY1, TM1, TC1, TK1, TY2, TM2, TC2, TK2. Hereinafter, a description is given taking the case where the toner TM1 is displaced in the main scanning direction (upward direction in FIGS. 7A and 7B) as an example.

As shown in FIG. 7A, when the toner image TM1 is displaced to one side in the main scanning direction with respect to the toner image TY1, an overlap occurs between the toner image TY1 and the toner image TM1, and a gap is generated between the toner image TM1 and the toner image TC1. In the portion where the toner image TY1 and the toner image TM1 overlap, the toner concentration becomes high as compared with the other parts of the toner images TY1, TM1, and the output signal V1 thus has a peak P7 with a lower potential as shown in FIG. 7A. Further, in the portion as the gap between the toner image TM1 and the toner image TC1, the toner concentration becomes low as compared with the other parts of the toner images TM1, TC1, and the output signal V1 thus has a peak P8 with a higher potential as shown in FIG. 7A.

On the other hand, in the test toner image TP2, the toner image TM2 is displaced to one side in the main scanning direction with respect to the toner image TY2, as shown in FIG. 7B. Thereby, an overlap occurs between the toner image TY2 and the toner image TM2, and a gap is generated between the toner image TM2 and the toner image TC2. In the overlapping portion where the toner image TY2 and the toner image TM2 overlap, the toner concentration becomes high as compared with the other parts of the toner images TY2, TM2, and the output signal V2 thus has a peak P9 with a lower potential as shown in FIG. 7B. Further, in the portion as the gap between the toner image TM2 and the toner image TC2, the toner concentration becomes low as compared with the other parts of the toner images TM2, TC2, and the output signal V2 thus has a peak P10 with a higher potential as shown in FIG. 7B. That is, when the print deviation in the main scanning direction occurs in the test toner images TP1, TP2, the output signals V1, V2 have the peaks P7, P9 with lower potentials and the peaks P8, P10 with higher potentials, while having the same waveform. Thereat, in this case, the control section 30 determines that print deviation in the main scanning direction has occurred, and determines that execution of the resist control is necessary.

When the magnification deviation occurs in the test toner images TP1, TP2, as shown in FIGS. 8A and 8B, a toner image (toner image TM2 in FIGS. 8A and 8B), corresponding to the scanning optical system in which color deviation has occurred, is displaced in the test toner image TP2. The boundaries B4 to B6 of the toner images TY2, TM2, TC2, TK2 are inclined with respect to the conveyance direction α as shown in FIG. 2. Therefore, as shown in FIG. 8A, a gap and an overlap occur on the boundaries among the toner images TY2, TM2, TC2, TK2. Hereinafter, a description is given taking, as an example, the case of occurrence of the magnification deviation in the scanning optical system for forming a magenta toner image.

When the magnification deviation occurs in the scanning optical system for forming the magenta toner image, displacement does not occur in the toner images TY1, TM1, TC1, TK1 in the test toner image TP1, and the toner image TM2 is displaced to one side in the main scanning direction with respect to the toner image TY2 in the test toner image TP2, as shown in FIGS. 8A and 8B. Therefore, the output signal V1 of the sensor 34*a* does not fluctuate during sensing of the toner concentration of the test toner image TP1, as in FIG. 5A (see FIG. 8A). On the other hand, in the test toner image TP2, an overlap occurs between the toner image TY2 and the toner image TM2, and a gap is generated between the toner image TM2 and the toner image TC2. In the portion where the toner image TY2 and the toner image TM2 overlap, the toner concentration becomes high as compared with the other parts of the toner images TY2, TM2, and the output signal V2 thus has a peak P11 with a lower potential as shown in FIG. 8B. Further, in the portion as the gap between the toner image TM2 and the toner image TC2, the toner concentration becomes low as compared with the other parts of the toner images TM2, TC2, and the output signal V2 thus has a peak P12 with a higher potential as shown in FIG. 8D.

As thus described, when the magnification deviation occurs in the test toner images TP1, TP2, the output signal V1 has a waveform not fluctuating during sensing of the toner concentration of the test toner image TP1, and the output signal V2 has the peak P11 with a lower potential and the peak P12 with a higher potential. Thereat, in this case, the control section 30 determines that magnification deviation has occurred, and determines that execution of the resist control is necessary.

Operation of Image Forming Apparatus

Figure 9:
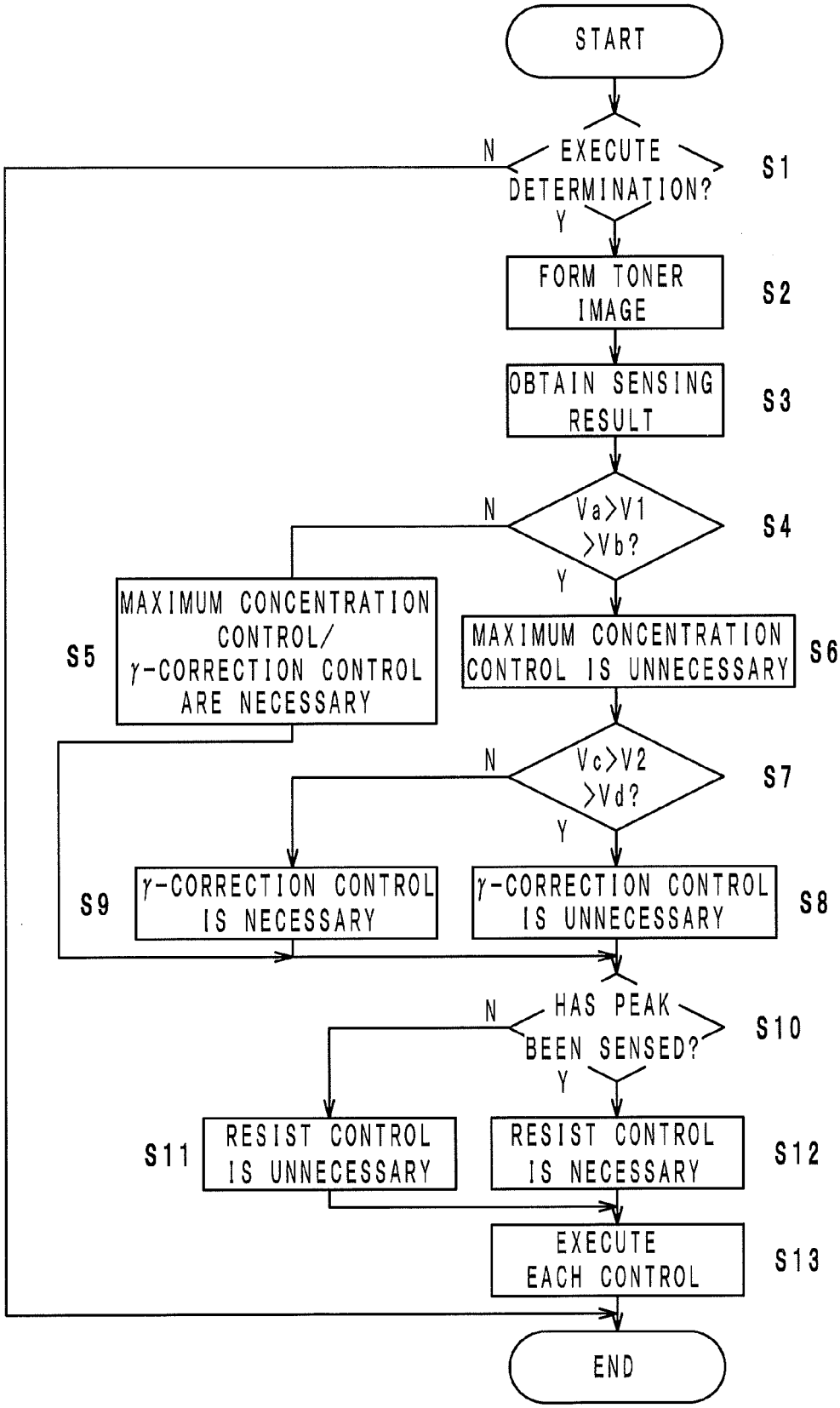
FIG. 9 is a flowchart showing an operation performed by a control section.

Hereinafter, the operation of the image forming apparatus 1 is described with reference to the drawings. The following operation is the necessity determination operation for determining the necessity to execute the maximum concentration control, the γ-correction control and the resist control. FIG. 9 is a flowchart showing the necessity determination operation performed by the control section 30.

First, the control section 30 determines whether or not to execute the necessity determination operation (step S1). Examples of a determination criterion in step 1 include whether or not it is immediately after turn-on of power of the image forming apparatus 1. Other examples of the determination criterion include: whether or not a temperature, humidity and the like have fluctuated by predetermined amounts or more, and whether or not a predetermined number of sheets of paper have been printed since previous execution of the necessity determination operation. In the case of executing the operation, the process goes to step S2. In the case of not executing the operation, the process is completed.

In the case of executing the operation, the control section 30 makes the intermediate transfer belt 11 form the test toner images TP1, TP2 on the printing section 2. (step S2). The sensors 34*a*, 34*b* sense toner concentrations of the test toner images TP1, TP2, to output the output signals V1, V2 to the control section 30. Thereby, the control section 30 obtains sensing results of the sensors 34*a*, 34*b* (step S3).

Next, the control section 30 determines whether or not the output signal V1 is smaller than the potential Va and is larger than potential Vb (step S4). In step S4, as shown in FIG. 3, the control section 30 determines whether or not the output signal V1 of the sensor 34*a* stays between the voltage Va and the voltage Vb, to thereby determine the necessity to execute the maximum concentration control. When the output signal V1 is not smaller than the potential Va or is not larger than the potential Vb, the process goes to step S5. On the other hand, when the output signal V1 is smaller than the potential Va and is larger than the potential Vb, the process goes to step S6.

Figure 10A:
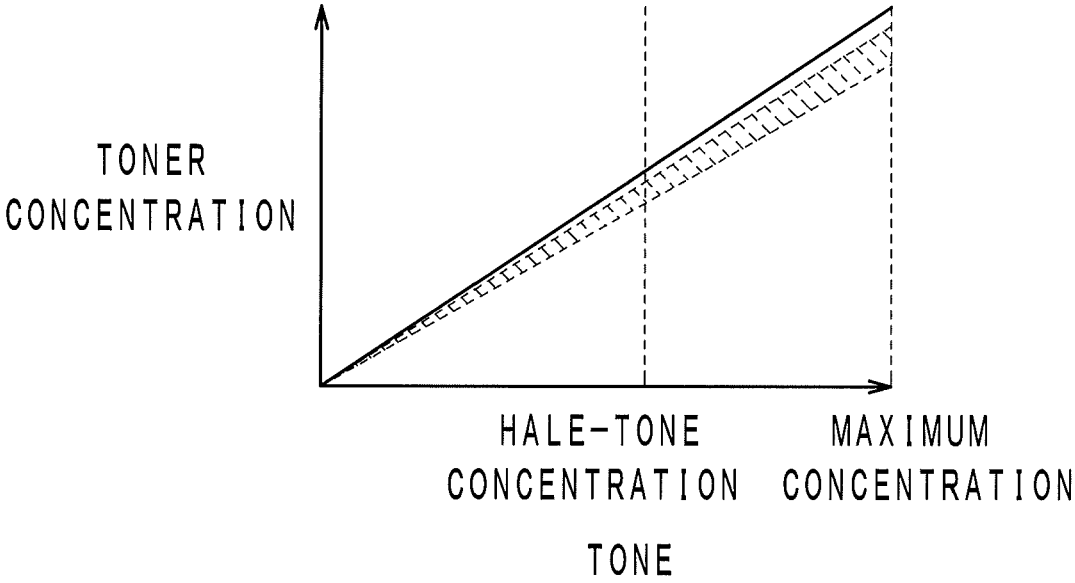
FIGS. 10A and 10B are graphs showing relations between tones and toner concentrations.
Figure 10B:
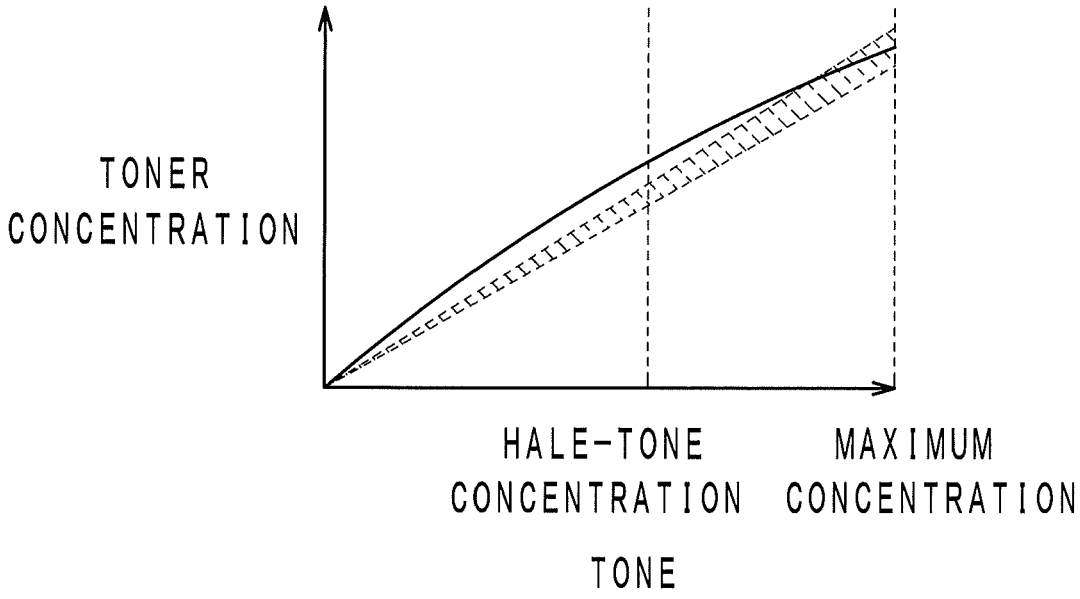

When the output signal V1 is not smaller than the potential Va or is not larger than the potential Vb, the control section 30 determines that execution of both the maximum concentration control and the γ-correction control are necessary (step S5). Herein, the reason for the determination that execution of γ-correction control is necessary in addition to the maximum concentration control is described with reference to the drawings. FIGS. 10A and 10B are graphs showing relations between tones and toner concentrations. A vertical axis indicates a toner concentration, and a horizontal axis indicates a tone. Shaded portions of FIGS. 10A and 10B show an appropriate range for the toner concentration in each tone.

In FIGS. 10A and 10B, the toner concentration increases with increase in tone. However, the relation between the tone and the toner concentration desirably stays within the shaded portions of FIGS. 10A and 10B. That is, when the relation between the tone and the toner concentration stay within the shaded portion, the maximum concentration control and the γ-correction control are not necessary. However, as shown in FIG. 10A, when the toner concentration on the maximum concentration is higher than the toner concentration within the shaded portion, the toner concentration on the half-tone concentration is presumed to be also higher than the toner concentration within the shaded portion. That is, the γ-correction control is also presumed to be necessary when the maximum concentration control is necessary. Therefore, in step S5, the control section 30 determines that execution of both the maximum concentration control and the γ-correction are necessary. Subsequently, the process goes to step S10.

When the output signal V1 is smaller than the potential Va and is larger than the potential Vb, the control section 30 determines that the maximum concentration control is unnecessary (step S6).

Next, the control section 30 determines whether or not the output signal V2 is smaller than the potential Vc and is larger than potential Vd (step S7). In step S7, as shown in FIG. 4, the control section 30 determines whether or not the output signal V2 of the sensor 34*b* stays between the voltage Vc and the voltage Vd, to thereby determine the necessity to execute the γ-correction control. Herein, as shown in FIG. 10B, even when the toner concentration on the maximum concentration stays within the shaded portion, the toner concentration on the half-tone concentration may not stay within the shaded portion. In this case, execution of the maximum concentration control is unnecessary, whereas execution of the γ-correction control is necessary. Therefore, the control section 30 determines whether or not execution of the γ-correction control is necessary in the case when execution of the maximum concentration control is unnecessary. When the output signal V2 is smaller than the potential Vc and is larger than potential Vd, the process goes to step S8. On the other hand, when the output signal V2 is not smaller than the potential Vc or is not larger than the potential Vd, the process goes to step S9.

When the output signal V2 is smaller than the potential Vc and is larger than the potential Vb, the control section 30 determines that execution of the γ-correction control is unnecessary (step S8). Subsequently, the process goes to step S10.

When the output signal V2 is not smaller than the potential Vc or is not larger than the potential Vd, the control section 30 determines that execution of the γ-correction control is necessary (step S9). Subsequently, the process goes to step S10.

In step S10, the control section 30 determines whether or not a peak has been sensed in the output signals V1, V2 (step 10). In step 10, the control section 30 senses whether or not the print deviation shown in FIGS. 6A to 8B or the magnification deviation has occurred by sensing the peak, to determine the necessity to execute the resist control. It should be noted that the peak is sensed by the control section 30 determining whether or not the potentials of the output signals V1, V2 have fluctuated by predetermined values or more within relatively short predetermined time. When the peak is not sensed, the process goes to step S11. When the peak is sensed, the process goes to step S12.

When the peak is not sensed, the control section 30 determines that execution of the resist control is unnecessary (step S11). Subsequently, the process goes to step S13.

When the peak is sensed, the control section 30 determines that execution of the resist control is necessary (step S12). Subsequently, the process goes to step S13.

In step S13, based upon the result of determination in steps S1 to S12, the control section 30 executes the maximum concentration control, the γ-correction control and the resist control (step S13). In addition, the relations between results of determination in steps S1 to S12 and the controls to be executed are shown in Table 1. With the above operation, the process is completed.

TABLE 1

| Determination result in each step | | | Necessity to execute each control | | |
|---|---|---|---|---|---|
| | | | Maximum concentration | γ-correction | Resist |
| Step S4 | Step S7 | Step S10 | control | control | control |
| No | — | No | ○ | ○ | x |
| | — | Yes | ○ | ○ | ○ |
| Yes | No | No | x | ○ | x |
| | | Yes | x | ○ | ○ |
| | Yes | No | x | x | x |
| | | Yes | x | x | ○ |

Effect

According to the image forming apparatus 1 as thus configured, it is possible to suppress a decrease in print rate due to execution of the maximum concentration control, the γ-correction control or the resist control. More specifically, when the number of sheets of printed paper, operation time and the like satisfy certain conditions, the digital image forming apparatus described in Japanese Patent Application Laid-Open No H08-251364 executes the image concentration stabilizing control even if there is no need for changing a grid potential and a bias potential before or after execution of the image concentration stabilizing control. Therefore, if certain conditions are satisfied during printing operation, the digital image forming apparatus interrupts the printing operation and performs the image concentration stabilizing control even if there is no need for changing a grid potential and a bias potential. Such interruption of the printing operation causes a decrease in print rate in the digital image forming apparatus.

On the other hand, when the number of sheets of printed paper, operation time and the like satisfy certain conditions, the image forming apparatus 1 forms the test toner images TP1, TP2, and determines the necessity to execute the maximum concentration control, the γ-correction control and the resist control based upon toner concentrations of the test toner images TP1, TP2. Therefore, the image forming apparatus 1 only executes necessary control among the maximum concentration control, the γ-correction control and the resist control based upon the determination result. Accordingly, even if certain conditions are satisfied during printing operation, the image forming apparatus 1 only executes necessary control based upon the result of the necessity determination operation. Consequently, interruption of the printing operation for a long period of time hardly occurs in the image forming apparatus 1, and deterioration in print rate of the image forming apparatus 1 is thus suppressed.

Further, in the image forming apparatus 1, the boundaries B1 to B6 of the toner images TY1, TM1, TC1, TK1, TY2, TM2, TC2, TK2 which constitute the test toner images TP1, TP2 form straight lines inclined with respect to the conveyance direction α. Therefore, when the print deviation in the main scanning direction occurs in the test toner images TP1, TP2, an overlap or a gap is formed among the toner images TY1, TM1, TC1, TK1, TY2, TM2, TC2, TK2. As a consequence, in the image forming apparatus 1, the print deviation or magnification deviation can be sensed by use of the test toner images TP1, TP2.

The present invention is useful for an image forming apparatus, and is particularly excellent in being capable of suppressing a decrease in print rate by executing an adjustment operation for deciding a driving condition for an image forming device, such as maximum concentration control, γ-correction control or resist control.

Although the present invention has been described with reference to the preferred embodiments above, it is to be noted that various changes and modifications are possible to those who are skilled in the art. Such changes and modifications are to be understood as being within the scope of the present invention.

What is claimed is:

1. An image forming apparatus, comprising:

an image carrier that carries a toner image;

an image forming device that forms the toner image with a plurality of colors on the image carrier;

a sensing device that senses a toner concentration of the toner image carried by the image carrier;

a control device that makes the image forming device form a test toner image on the image carrier, and individually determines, for each of a plurality of adjustment operations, whether to execute each adjustment operation for adjusting driving conditions for the image forming device, based upon a toner concentration of the test toner image;

wherein at least one of the driving conditions is a condition concerning superimposition of the toner images with the plurality of colors;

wherein the test toner image is conveyed by the image carrier in a predetermined direction, the test toner image being formed of toner images with a plurality of colors aligned in the predetermined direction and boundaries arranged between the toner images, the boundaries including portions not orthogonal to the predetermined direction; and wherein the toner images of the test toner image are arranged without any gap or overlap on the boundaries when the driving conditions do not require correction.

2. The image forming apparatus according to claim 1, wherein the driving condition is a condition concerning a maximum toner concentration which is a highest concentration that can be formed by the image forming device, or a condition concerning an intermediate toner concentration which is lower than the maximum toner concentration.

3. The image forming apparatus according to claim 1, wherein the control device determines whether to execute more than one adjustment operation to adjust driving conditions of the image forming device.

* * * * *